US006930232B2

(12) United States Patent
Shigenaga

(10) Patent No.: US 6,930,232 B2
(45) Date of Patent: Aug. 16, 2005

(54) HIGH-HAT STAND

(75) Inventor: Fumihiro Shigenaga, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 196 days.

(21) Appl. No.: 09/882,545

(22) Filed: Jun. 15, 2001

(65) Prior Publication Data

US 2001/0052282 A1 Dec. 20, 2001

(30) Foreign Application Priority Data

Jun. 16, 2000 (JP) ..... 2000-181646

(51) Int. Cl.[7] ..... G10D 13/02
(52) U.S. Cl. ..... 84/422.3
(58) Field of Search ..... 84/422.1, 422.2, 84/422.3; 248/121, 122.1, 124.2, 125.8, 126

(56) References Cited

U.S. PATENT DOCUMENTS 4,381,690 A * 5/1983 Kimble ..... 84/422.3
4,488,471 A * 12/1984 Youakim ..... 248/158
5,018,426 A * 5/1991 Suzuki ..... 84/422.3
5,388,495 A * 2/1995 Atsumi ..... 84/422.3
5,482,235 A * 1/1996 Atsumi ..... 248/121
6,075,192 A * 6/2000 Hoshino ..... 84/422.3
6,229,080 B1 * 5/2001 Ishimatsu ..... 84/422.1
6,239,343 B1 * 5/2001 Hoshino ..... 84/422.3

FOREIGN PATENT DOCUMENTS

| | | |
|---|---|---|
| JP | 37-11712 | 5/1962 |
| JP | 37-12757 | 9/1962 |
| JP | H3-62214 | 6/1991 |
| JP | H11-15466 | 1/1999 |
| JP | H11-242480 | 9/1999 |

* cited by examiner

*Primary Examiner*—Kimberly Lockett
(74) *Attorney, Agent, or Firm*—Koda & Androlia

(57) ABSTRACT

An operating rod of a high-hat stand comprising an upper rod member and a lower rod member that are threadably connected to each other by a connecting assembly so that the operating rod is movable upward and downward by a foot pedal and causes a movable cymbal to move up and down with respect to a stationary cymbal. The connecting assembly includes an elastic section that is compressed upon connection of the upper and lower rod members and elastically recovers to its original shape when the upper and lower rod members are separated. The elastic section is formed inside the connecting assembly and can be provided on an exterior thereof.

2 Claims, 7 Drawing Sheets

HIGH-HAT STAND

BACKGROUND OF THE INVENTION

1. Field of the Invention

The present invention relates to a high-hat stand used in, for instance, drum sets and more particularly to a structure of a connecting section that connects an upper rod member and a lower rod member.

2. Prior Art

In a high-hat stand, an operating rod is set inside a hollow pipe member so as to be movable upward and downward by a foot pedal, and the operating rod moves a movable cymbal attached at the top thereof up and down relative to a stationary cymbal. The operating rod is comprised of an upper rod member and a lower rod member, and these rod members are threadably connected so that they can be separated.

One example this type of connecting structure for the upper and lower rod members is shown in FIG. 12.

In this connecting structure for a high-had stand, the upper rod member 100 and the lower rod member 101 are connected by a connecting nut 102; and an upper lock nut 103 and lower lock nut 104 are further employed. However, when the lock fastening of the connecting nut 102 by the upper lock nut 103 is weak, the upper rod member 100 and the connecting nut 102 become loose during play (musical performance), and noise generates upon the up and down movement of the threadably connected upper and lower rod members 100 and 101. In other words, noise is generated when a foot pedal (not shown) is operated.

Japanese Patent Application Laid-Open (Kokai) No. H11-242480 solves this problem. As seen from FIG. 13, in this prior art, the lower end surface 110 of an upper nut 111 is formed in a protruding conical shape, and the upper end surface 112 of a connecting nut 113 is formed in a recessed conical shape; and these nuts 111 and 113 are engaged at their conical end surfaces with the lower end surface 110 of the upper nut 111 snugly disposed in the upper end surface 112 of the connecting nut 113. As a result, a more secure thread-engagement of the upper and lower rods 114 and 115 compared to the prior art of FIG. 12 is obtained.

However, as described above, when the lock fastening of the connecting nut 102 by the upper lock nut 103 is weak, noise is generated. Though Japanese Patent Application Laid-Open (Kokai) No. H11-242480 attempts to solve this problem, the structure of this prior art requires conical shape processing on the upper nut 111 and connecting nut 113 that requires a fairly high precision work.

SUMMARY OF THE INVENTION

Accordingly, one object of the present invention is to provide a structure that prevents looseness in the connecting section for upper and lower rod members in high-had stands.

It is another object of the present invention to provide a connecting section that connects upper and lower rod members with a different structure from prior art so as to eliminate the need for bothersome conical shape processing on the connecting elements.

The above objects are accomplished by a unique structure for an upper and lower rod member connecting structure of the present invention for a high-hat stand in which an operating rod, which is movable upward and downward by a foot pedal so as to cause a movable cymbal to move up and down relative to a stationary cymbal, is comprised of an upper rod member and a lower rod member that are threadably connected by a connecting section; and in the present invention, an elastic section which is compressed upon connection of the rod members and undergoes elastic recovery upon separation of the rod members is disposed in the connecting section.

With this elastic section provided in the connecting section, the resilient force of the elastic section firmly holds the threaded connection of the rod members, and such an elastic section prevents loosening of the rod members that would be caused by vibration during play.

DETAILED DESCRIPTION OF THE INVENTION

Figure 1:
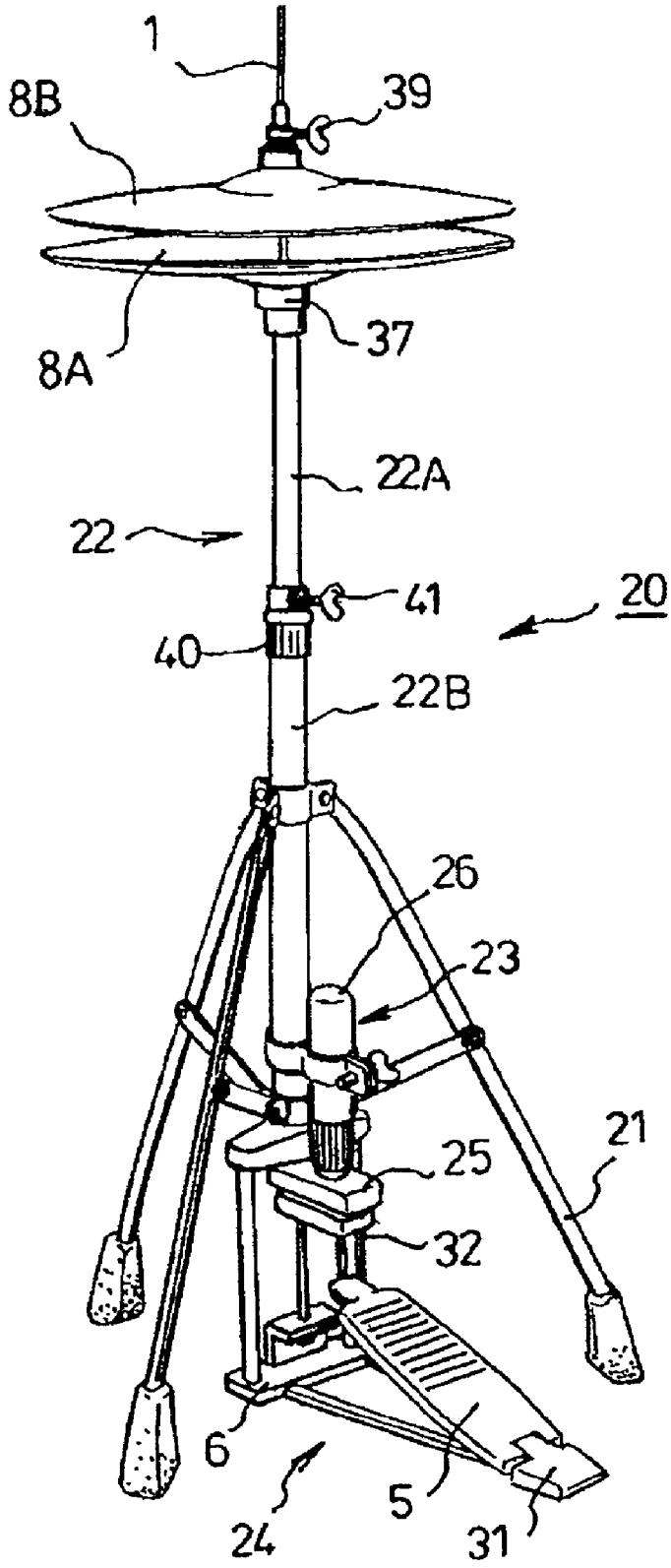
FIG. 1 is an overall perspective view of the high-hat stand according to the present invention.

As seen from FIG. 1, the high-hat stand 20 of the present invention substantially comprises a hollow stand main body 22, an operating rod 1, a spring device 23, and a pedal assembly 24.

The hollow stand main body 22 is installed vertically on a floor surface by means of a foldable tripod 21. The operating rod 1 passes through the hollow stand main body 22 so that the operating rod 1 is movable upward and downward. The spring device 23 drives the operating rod 1 upward. The pedal assembly 24 is disposed on the lower portion of the stand main body 22. A lower stationary cymbal 8A is attached to the upper portion of the stand main body 22 by an attachment piece 37, and an upper movable cymbal 8B is attached to the upper portion of the operating rod 1 by an attachment screw 39.

Figure 2:
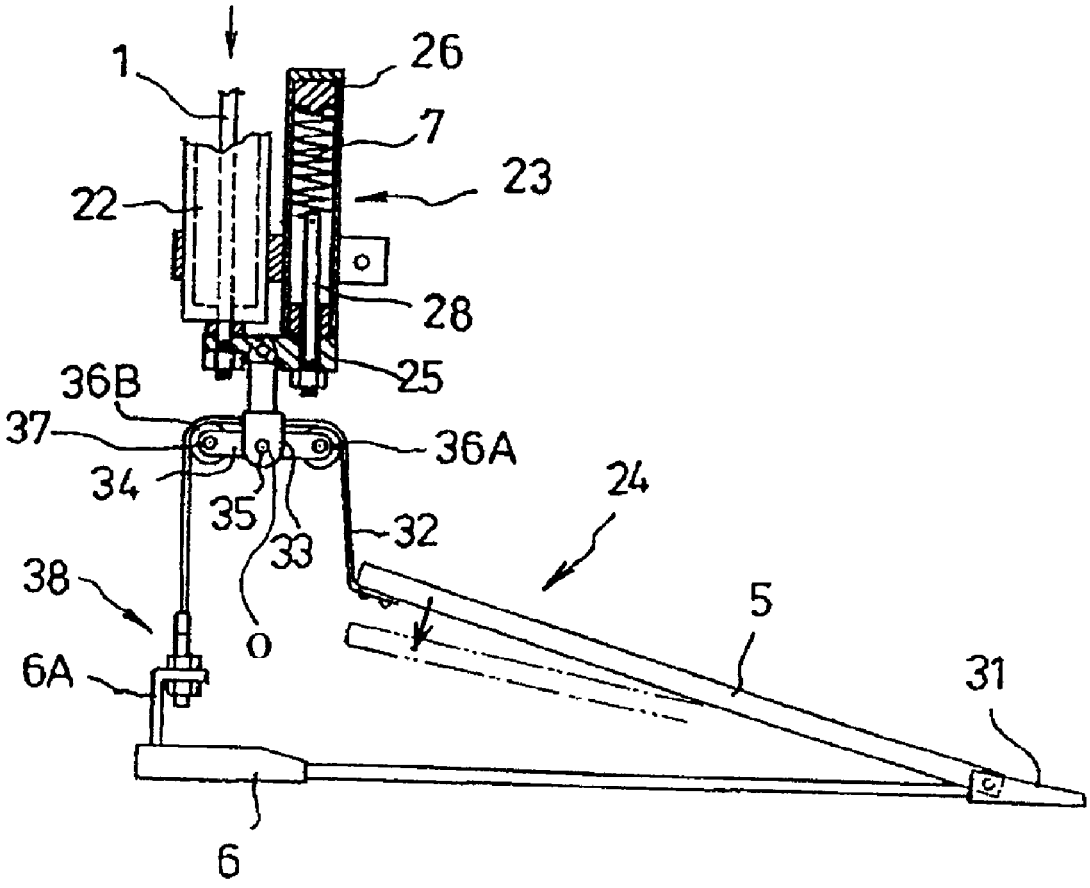
FIG. 2 shows a connecting structure between the operating rod and a pedal in the high-hat stand of the present invention.

The detail of the spring device 23 is shown in FIG. 2. The structure of the spring device 23 is similar to that disclosed in Japanese Patent Application Laid-Open (Kokai) No. H11-15466.

The spring device 23 comprises a pipe housing 26 which is fastened to the outer circumference of the stand main body 22, a return spring 7 which is installed inside the pipe housing 26 with its upper end connected to the pipe housing 26, and a spring rod 28 which is inserted into the interior of the pipe housing 26 from below with its upper end connected to the lower end of the return spring 7. The spring rod 28 is set vertically on a connecting member 25 that is attached to the lower end of the operating rod 1.

The pedal assembly 24 is comprised of, along with other components, a pedal frame 6 which is set on the floor surface, a pedal 5 which is connected to the heel 31 of the pedal frame 6 so that the pedal 5 pivots up and down at the rear end, and a transmission member 32 which connects the front end of the pedal 5 to the lower end of the operating rod 1.

One example of the connecting structure of the operating rod 1 and pedal 5 is shown also in FIG. 2. This structure is similar to that disclosed in Japanese Patent Application Laid-Open (Kokai) No. H11-15466.

More specifically, a roller link 34 is attached to the connecting member 25 via a bearing 33. The roller link 34 is formed long in the forward-rearward direction of the pedal 5. The center of the roller link 34 is shaft-supported by a rotating shaft 35 installed on the bearing 33 so that the roller link 34 swings up and down. Rotating bodies 36A and 36B which are rotatably shaft-supported by pins 37 are respectively disposed on the front and rear end portions of the roller link 34. The rotating bodies 36A and 36B are identical, and they are installed so as to be separated from the pivoting center O of the roller link 34 by a fixed distance. One end of the transmission member 32 is fastened to the front end portion of the pedal 5, while another end thereof is connected via an length adjustment mechanism 38 to a connecting portion 6A installed integrally to the pedal frame 6. The mid-point portion of the transmission member 32 is installed across the rotating bodies 36A and 36B.

In the initial state, the pedal 5 is held so that front end of the pedal 5 floats upward as shown in FIGS. 1 and 2. When the pedal 5 is depressed by foot during play, the connecting member 25 is pulled down overcoming the spring force of the return spring 7. As a result, the operating rod 1 connected to the connecting member 25 is lowered as an integral unit with the connecting member 25, and the upper movable cymbal 8B strikes the lower stationary cymbal 8A.

The stand main body 22 is comprised of an upper pipe member 22A and a lower pipe member 22B as seen from FIG. 1. The upper and lower pipe members 22A and 22B are fastened together by a tightening screw 41 provided on an attachment ring 40. The operating rod 1 is comprised of an upper rod member 1A and a lower rod member 1B, and these rod members 1A and 1B are connected to each other by a connecting section 42 in a manner that the rod members 1A and 1B can be separated.

In the connecting section 42, an elastic section 43 is provided so that the elastic section 43 is compressed when the rod members 1A and 1B are connected by the connecting section 42 and then undergoes elastic recovery when the rod members 1A and 1B are separated.

Figure 3:
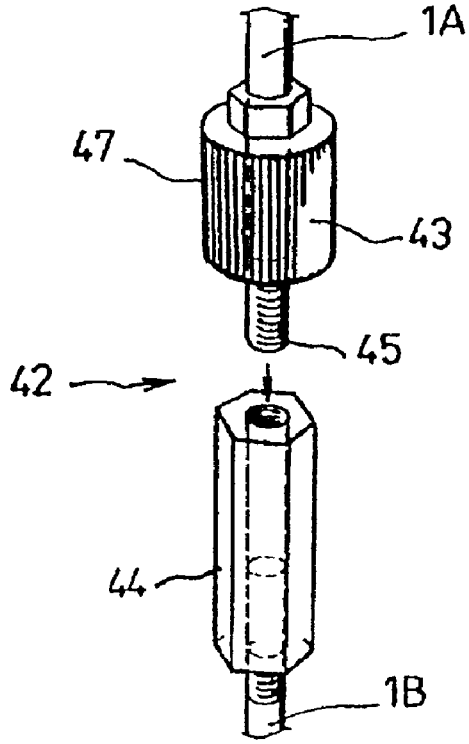
FIG. 3 is a perspective view of the connecting section of the high-hat stand according to the present invention.
Figure 4:
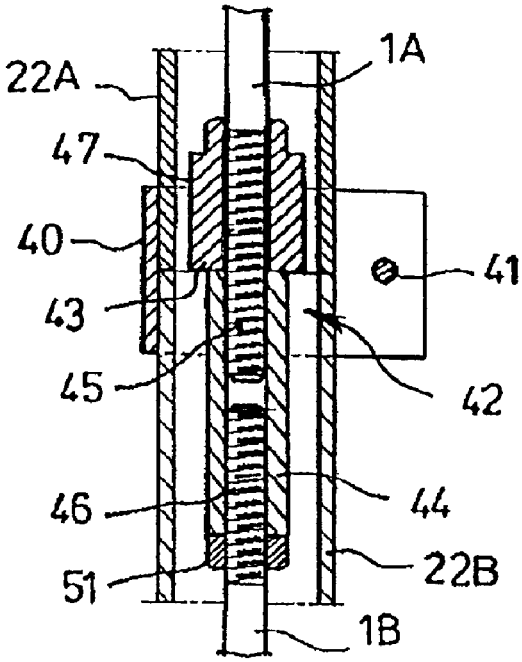
FIG. 4 shows a longitudinal cross-section of the connecting section of the high-hat stand according to the present invention.

More specifically, as seen from FIGS. 3 and 4, the upper rod member 1A and the lower rod member 1B are disengageably connected by the connecting section 42 via a thread-engagement. The connecting section 42 is comprised of a connecting nut 44 and an upper nut member 47, and the connecting section 42 connects the upper rod member 1A and the lower rod member 1B co-axially or in end-to-end relation. In other words, an external thread 45 is formed on the lower portion of the upper rod member 1A, and an external thread 46 is formed on the upper portion of the lower rod member 1B; and these threads 45 and 46 are connected by an internal thread formed on the inside surface of the connecting nut 44. The rod members 1A and 1B are thus threadably connected by the connecting nut 44.

The connecting nut 44 can be fastened to the lower rod member 1B by press-fitting or some other appropriate method and not via threads as described above. The upper rod member IA is threadably engaged to the connecting nut 44 by turning the upper nut member 47.

Figure 5:
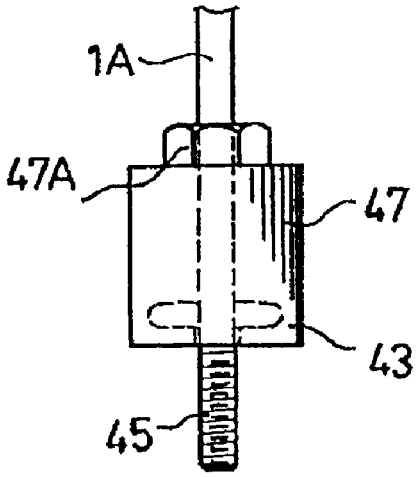
FIG. 5 is a side view of the upper nut member that comprises the connecting section of the high-hat stand of the present invention.

The upper nut member 47 is preferably made of a synthetic resin, and it is fastened to the upper rod member 1A by press-fitting or some other appropriate method so that the upper nut member 47 is disposed in the area above the external thread 45. A roulette-worked portion is formed on the outer surface of the upper nut member 47. The roulette-worked portion is formed in order to facilitate the turning of the upper nut member 47. A hexagonal nut portion 47A is, as shown in FIG. 5, formed on the upper end of the upper nut member 47 in order to allow turning of the upper nut member 47 by a spanner and the like tools.

Accordingly, the upper rod member 1A is turned and threadedly engaged with the connecting nut 44 as seen from FIG. 4 when the upper nut member 47 is turned, and the upper rod member 1A and lower rod member 1B are thus connected co-axially. When the rod members 1A and 1B are thus connected by the connecting nut 44, by way of the load from the upper rod member 1A to which the movable cymbal 8B is attached, a firm connection of the upper nut member 47 and the connecting nut 44 is attained.

A lock nut 51 is screwed on the external thread 46 of the lower rod member 1B. The lock nut 51 contacts the undersurface of the connecting nut 44 and prevents loosening of the connecting nut 44.

In the present invention, an elastic section 43, which is compressed upon connection of the rod members 1A and 1B and elastically recovers upon separation of the rod members 1A and 1B, is disposed in the connecting section 42. The elastic section 43 is disposed in the area in which the upper nut member 47 and the connecting nut 44 are joined; and the elastic section 43 is provided on one of or both of these components, the upper nut member 47 and the connecting nut 44. In addition, the elastic section 43 can be obtained by way of forming the upper nut member 47 and/or the connecting nut 44 with an elastic material. In the shown preferred embodiment, the elastic section 43 is provided in the upper nut member 47.

Figure 6:
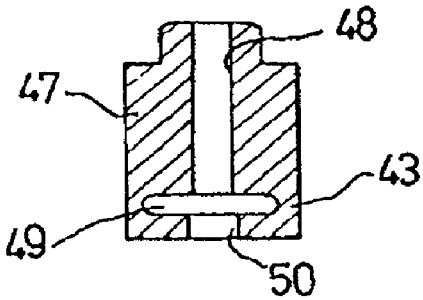
FIG. 6 is a longitudinal sectional view of the upper nut member of FIG. 5.
Figure 7:
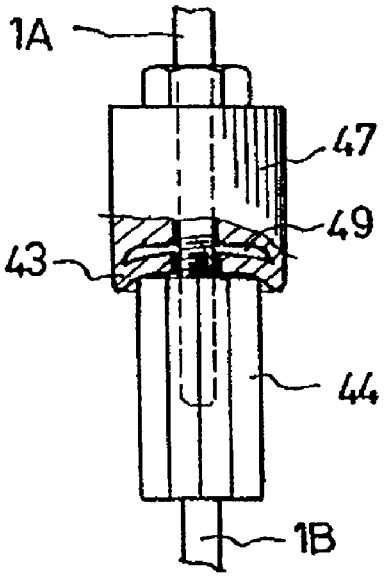
FIG. 7 is a side view of the upper nut member thereof connected to a connecting nut.

In the embodiment shown in FIGS. 5 through 7, the upper nut member 47 is formed with an axial hole 48, which is fastened by press-fitting to the upper rod member 1A, and a lateral hollow portion 49, which extends in the lateral direction or at right angles relative to the axial hole 48 in the lower portion of the upper nut member 47. The elastic section 43 is thus formed in the area that surrounds the lateral hollow portion 49. As best seen from FIG. 6, a part of the axial hole 48 that locates below the lateral hollow portion 49 has a larger diameter than the rest of the axial hole 48 (that locates above the lateral hollow portion 49), so that a flexible shape portion 50 in the lower part of the upper nut member 47 can change its shape as described below.

With the structure above, when the rod members 1A and 1B are connected by the connecting section 42, as shown in FIG. 7 the flexible shape portion 50 of the upper nut member 47 that is located below the lateral hollow portion 49 is pressed by the connecting nut 44 and squeezed so as to change its shape. As a result, the vertical dimension of the lateral hollow portion 49 is narrowed or compressed to zero. In other words, the elastic section 43 formed in the area around the lateral hollow portion 49 is compressed against the elasticity of the elastic section 43. Accordingly, the thread engagement between the external thread 45 of the upper rod member 1A and the internal thread formed on the inside surface of the connecting nut 44 is firmly maintained, and loosening of the upper nut member 47 (and the rod members 1A and 1B) by vibration during play can be prevented.

The material of the upper nut member 47 is selected with the function of the elastic section 43 taken into consideration. Thus, it is preferable that the upper nut member 47 be formed into a specified shape from, for instance: a synthetic resin such as a polypropylene, polyurethane type elastomer and polyester type elastomer; a rubber material such as natural rubber and a synthetic rubber (e.g., butyl rubber, butadiene rubber, NBR (nitrile butadien rubber) or CR (chloroprene rubber)); and foamed materials thereof. The hardness values of these materials range from 90 to 100 (in Shore A hardness).

When the rod members 1A and 1B are separated by turning the upper nut member 47, the vertical dimension of the lateral hollow portion 49 increases to its original value, the lateral hollow portion 49 and the flexible shape portion 50 return to their original shapes by the elastic recovery force of the elastic section 43, and the elastic section 43 thus recovers.

Figure 8:
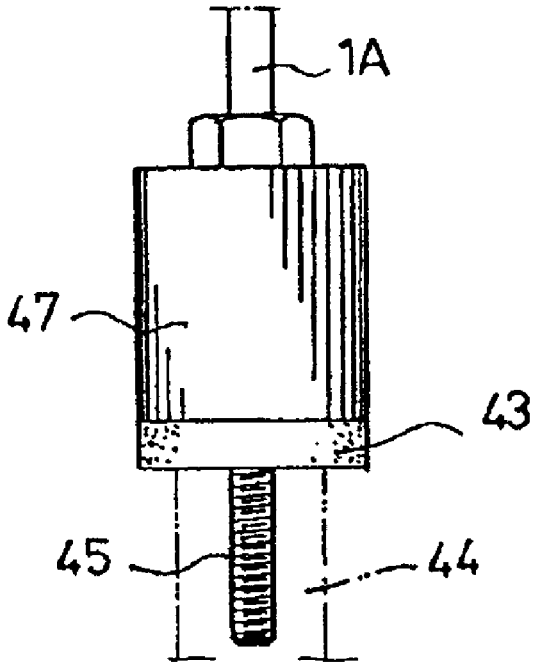
FIG. 8 is a side view of the upper nut member of the connecting section of another embodiment of the high-hat stand according to the present invention.
Figure 9:
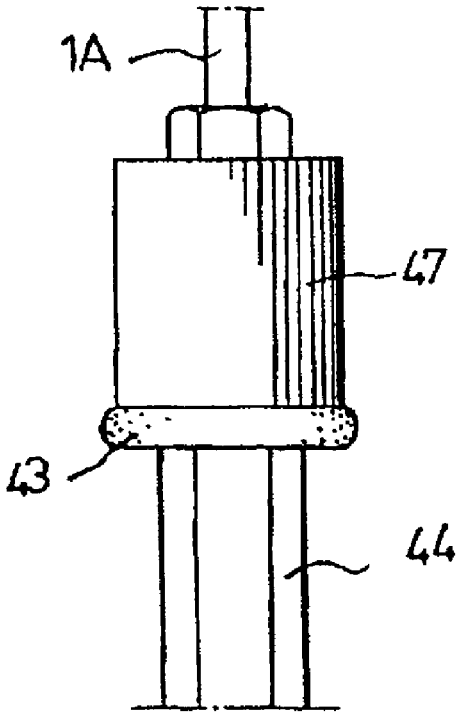
FIG. 9 is a side view of the upper nut member connected to a connecting nut.

FIGS. 8 and 9 illustrate another embodiment of the present invention. In this embodiment, the elastic section 43 is a cylindrical block that is made from a material such as natural rubber, a synthetic resin, etc. that possesses elasticity. The cylindrical block is disposed on the undersurface of the upper nut member 47 as an integral part thereof by bonding, etc.

When the rod members 1A and 1B are connected, the elastic section or the cylindrical block 43 is compressed as shown in FIG. 9. Thus, the thread engagement between the external thread 45 of the upper rod member 1A and the internal thread of the inside surface of the connecting nut 44 is firmly maintained.

In this embodiment also, the material of the elastic section or the cylindrical block 43 is selected with the function of the elastic section 43 taken into consideration. Thus, it is preferable that the elastic section 43 be formed into a specified shape from, for instance: a synthetic resin such as a polypropylene, polyurethane type elastomer and polyester type elastomer; and a rubber material such as natural rubber and a synthetic rubber (e.g., butyl rubber, butadiene rubber, NBR or CR). The hardness values of these materials range from 90 to 100 (in Shore A hardness). The upper nut member 47 can be molded from a similar material.

Figure 10:
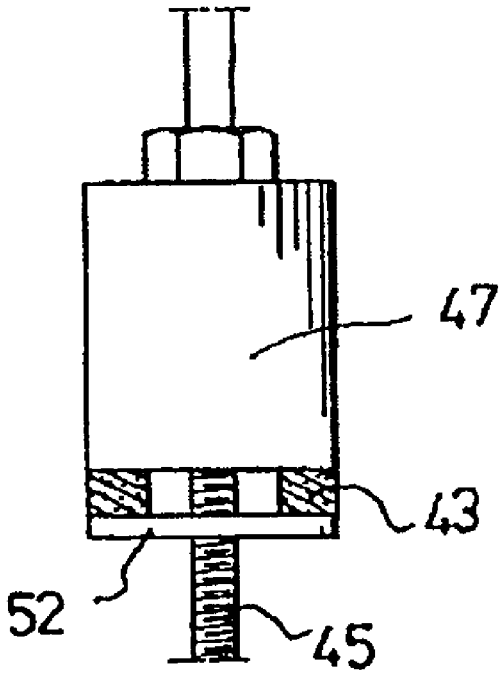
FIG. 10 is a partially sectional side view of the upper nut member of the connecting section of the high-hat stand according to the present invention.
Figure 11:
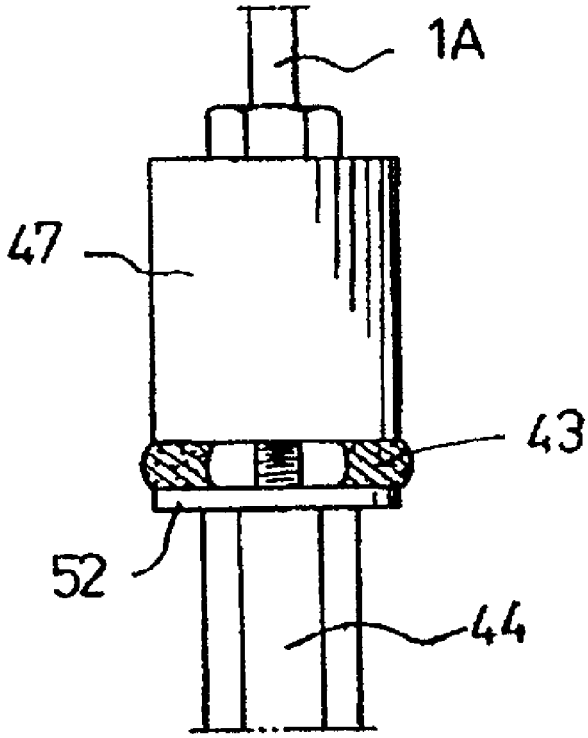
FIG. 11 is a side view of the upper nut member of FIG. 10 connected to a connecting nut.
Figure 12:
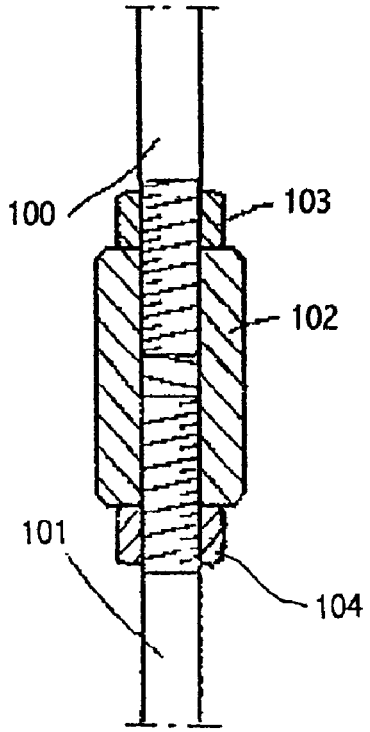
FIG. 12 PRIOR ART
FIG. 12 shows a cross section of prior art connecting structure for upper and lower rod members.
Figure 13:
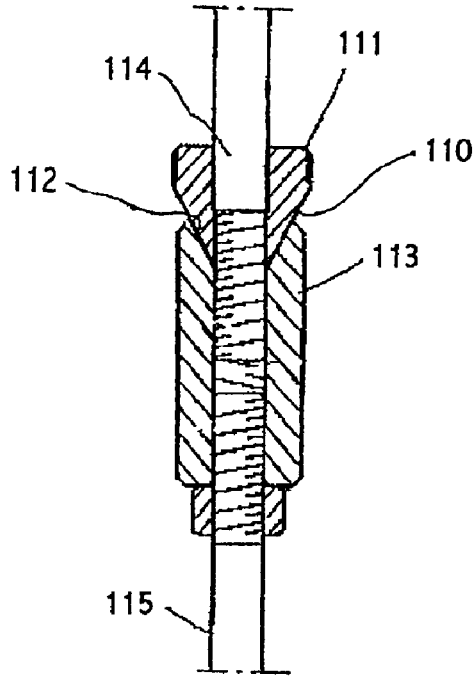
FIG. 13 PRIOR ART
FIG. 13 shows a cross section of another prior art connecting structure for upper and lower rod members.

FIGS. 10 and 11 illustrate still another embodiment of the present invention. In this embodiment, the elastic section 43 is a cylindrical block disposed in the connecting section 42, and it is comprised of a material such as a synthetic resin and natural rubber that possesses elasticity. The elastic section or the cylindrical block 43 is attached to the undersurface of the upper nut member 47 by means of, for instance, bonding, and a reinforcing plate 52 is attached to the undersurface of the cylindrical block 43 by means of, for example, bonding.

Thus, when the rod members 1A and 1B are connected, the elastic section or the cylindrical block 43 is compressed via the reinforcing plate 52 as shown in FIG. 11. As a result, the thread engagement between the external thread 45 of the upper rod member 1A and the internal thread formed on the inside surface of the connecting nut 44 is firmly maintained.

In this embodiment also, the material of the elastic section 43 is selected with the function of the elastic section 43 taken into consideration. Thus, it is preferable that the elastic section 43 or the cylindrical block be formed into a specified shape from, for instance: a synthetic resin such as a polypropylene, polyurethane type elastomer and polyester type elastomer; and a rubber material such as natural rubber and a synthetic rubber (e.g., butyl rubber, butadiene rubber, NBR or CR). The hardness values of these materials range from 80 to 90 (in Shore A hardness). The upper nut member 47 can be molded from a similar material to the cylindrical block 43; and in this case, the hardness value of the material is set at a slightly harder Shore A hardness of 90 to 100.

In the embodiments shown in FIGS. 8 through 11, the cylindrical block 43 can be divided into a plurality of arc pieces, so that these arc pieces are arranged in a circular fashion with equal intervals in between along the circumferential edge of the upper nut member 47.

In the above embodiments, when the upper nut member 47 is molded from a synthetic resin, the elastic section 43 can be integrally molded from a synthetic resin on the lower portion of the upper nut member 47 by a double molding method. In this case, the process of bonding a separate part (the cylindrical block 43) is eliminated, and manufacture of the upper nut member 47 is facilitated.

In addition, in the above embodiments, the elastic section 43 is provided on the upper nut member 47 internally and externally. However, it goes without saying that the elastic section 43 can be formed inside the connecting nut 44 or be provided on its end surface that faces the upper nut member 47.

As seen from the above, in the high-hat stand of the present invention, the upper rod member and lower rod member are threadably connected in a disengageable fashion by a connecting section; and an elastic section, which is compressed upon connection of the rod members and elastically recovers when the rod members are separated, is disposed in the connecting section. Accordingly, the resilient force in the elastic section reinforces the connecting force of the threads of the connecting section, and loosening of the upper and lower rod members can be prevented. As a result, looseness of the movable cymbal during play (musical performance) is prevented, and a desired cymbal play can be assured. Furthermore, this effect can easily be achieved by disposing the elastic section on the upper nut member so that the elastic section is compressed when the connecting nut is connected. Moreover, there is no danger that the elastic section will come loose from the upper nut member and be lost.

The present invention is not limited to the embodiments described above. Various alterations are possible without departing from the technical scope of the present invention, and the present invention includes various embodiments involved in such alterations.

With the present invention, the upper and lower rod members that are threadably connected each other is prevented from loosening without any need to work the shapes of the upper nut member and connecting nut into conical shapes as in the conventional structure.

Furthermore, since the elastic section is disposed on the upper nut member and compressed when the upper nut member is connected to the connecting nut, loosening in these components can prevented with a simple structure. In addition, the number of parts is reduced and assembling becomes easier since the elastic section is molded as an integral part of the upper nut member.

What is claimed is:

1. A high-hat stand comprising:

an upper rod member with a movable cymbal at one end thereof and an external thread formed at another end thereof:

a lower rod member with a foot pedal connected at one end thereof and an external thread formed at another end thereof;

a connecting nut that threadably connects said another end of said upper rod member to said another end of said lower rod member;

an upper nut member that is disposed near said another end of said upper rod, said upper nut member coming into contact with said connecting nut when said upper rod member and said lower rod member are connected by said connecting nut, said upper nut member being provided with an elastic section that is compressed upon connection of said upper and lower rod members and undergoes elastic recovery upon separation of said upper and lower members; and wherein said elastic section is comprised of a cylindrical block that is provided on an end surface of said upper nut member so that said cylinder block is disposed between said upper nut member and said connecting nut when said upper and lower rod members are connected; and a reinforcing plate is attached to said cylindrical block so that said cylindrical block is disposed between said upper nut member and said connecting nut when said upper and lower rod members are connected.

2. The high-hat stand according to claim 1, wherein said cylindrical block is formed from a material selected from the group consisting of polypropylene, polyurethane type elastomer, polyester type elastomer, natural rubber and a synthetic rubber.

* * * * *